US007004208B2

(12) United States Patent
Liu

(10) Patent No.: US 7,004,208 B2
(45) Date of Patent: Feb. 28, 2006

(54) ACCUMULATED OIL SEPARATOR FOR OIL-GAS RECOVERY SYSTEM

(76) Inventor: Ming Hua Liu, No. 59, Sec. 1, Zhongzhou Rd., Tianzhong Town, Changhua County 520 (TW)

( * ) Notice: Subject to any disclaimer, the term of this patent is extended or adjusted under 35 U.S.C. 154(b) by 21 days.

(21) Appl. No.: 10/879,016

(22) Filed: Jun. 30, 2004

(65) Prior Publication Data

US 2006/0011256 A1 Jan. 19, 2006

(51) Int. Cl.
*B67D 5/00* (2006.01)

(52) U.S. Cl. ..... 141/59; 141/44; 141/290; 141/382

(58) Field of Classification Search ..... 141/44, 141/45, 59, 290, 382
See application file for complete search history.

(56) References Cited

U.S. PATENT DOCUMENTS 4,260,000 A * 4/1981 McGahey et al. ..... 141/59
4,687,033 A * 8/1987 Furrow et al. ..... 141/59
5,042,537 A * 8/1991 Grantham ..... 141/59
5,056,569 A * 10/1991 Walker et al. ..... 141/44
5,148,840 A * 9/1992 Grantham ..... 141/44
5,240,045 A * 8/1993 Faeth ..... 141/1
5,520,228 A * 5/1996 Fink et al. ..... 141/59
5,725,030 A * 3/1998 Berger et al. ..... 141/59
6,848,481 B1 * 2/2005 Bay et al. ..... 141/65
6,866,299 B1 * 3/2005 Coates ..... 285/123.15

* cited by examiner

*Primary Examiner*—J. Casimer Jacyna
(74) *Attorney, Agent, or Firm*—Troxell Law Office, PLLC

(57) ABSTRACT

The accumulated oil separator has a main body with an oil-gas connecting pipe on its front end and with an axial central hole having a predetermined diameter: a through hole in the main body is concentric with an axial central hole of the oil-gas connecting pipe; a radially extending chamber is extended down a predetermined depth from the top of the main body and is communicated on its two lateral sides with the axial central hole and the through hole; a regulatory controlling means is mounted in the radial chamber to control normal oil filling and oil-gas recovery, or can be regulated to be in an accumulated oil removing state; an accumulated oil discharging outlet is formed by drilling to communicate transversely with the radial chamber; the regulatory controlling means can directly discharge accumulated oil from the oil-gas recovery system for collection when it is adjusted to discharge accumulated oil.

3 Claims, 6 Drawing Sheets

ACCUMULATED OIL SEPARATOR FOR OIL-GAS RECOVERY SYSTEM

BACKGROUND OF THE INVENTION

1. Field of the Invention

The present invention is related to an accumulated oil separator for an oil-gas recovery system, and especially to an oil separator suitable for getting rid of the cause of fault on the front end of the oil gas recovery system; the oil separator can fast and conveniently remove oil without dismantling any related equipment.

2. Description of the Prior Art

Generally, oil device (such as an oil gun) of an oil filler is provided with an oil-gas recovery system to prevent the oil gas in filling oil in site from being too dense. Such an oil-gas recovery system recovers oil gas mainly by means of an oil-gas recovery pipe and a related air pump, the rate of recovery (i.e., the ratio of air/liquid oil A/L) is about in the range of 0.88–1.2.

However, by virtue that different habits of oil filling of consumers and undue operation of a staff at the worksite often induce the fault of more recovery rate of the accumulated oil in the oil-gas recovery pipe. The disadvantages induced by the fault of oil accumulation in the oil-gas recovery pipe include:

1. The fault of oil accumulation renders the trigger of the oil gun not to leap to stop filling, this will result spillage of oil, and not only will result wasting of the energy source and loss of a consumer, but also will incur argument and complaining.
2. Inability of recovering oil gas will make the oil gas in filling oil in site too dense; this may affect the health of consumers and the staffs.
3. The accumulated oil in the oil-gas recovery pipe not only gets none recovery rate of the oil gas, but also makes damage of the oil filler, the air pump and a related electronic equipment.

Because of the disadvantages induced by the oil accumulation of oil-gas recovery system, generally staffs in the worksite of a gas station must often do maintenance and repairing. Such routine maintenance and repairing must have oil fillers and the related oil pipes dismantled, and the accessories dismantled must be reassembled to recover their original positions after removing the accumulated oil. Such routine maintenance and repairing works are very cumbersome and time consuming, and surely are additional burdens to the staffs in the worksite of the gas station.

SUMMARY OF THE INVENTION

The primary object of the present invention is to provide an accumulated oil separator for an oil-gas recovery system, the oil separator is suitable for getting rid of the cause of fault on the front end of the oil-gas recovery system by conveniently removing oil without dismantling any related equipment.

To get the abovementioned object, the present invention is provided with a main body having an outer screw-connecting end and a rear inner screw hole as well as being assembled on a pipeline of an oil-gas recovery system. The main body is provided with a plurality of oil passageways on the inner wall of and extending from the front end to (and communicating with) the rear end of the main body; an oil-gas connecting pipe spaced away from the oil passageways is provided on the front end of the main body, and has an axial central hole with a predetermined diameter; and a through hole with a predetermined length is extended inwardly from the rear inner screw hole and is concentric with the axial central hole of the oil-gas connecting pipe; a radially extending chamber is extended downwardly a predetermined depth from the top surface of the main body and is communicated on its two lateral sides with the axial central hole of the oil-gas connecting pipe and the through hole with a predetermined length; a regulatory controlling means is mounted in the radially extending chamber to control normal oil filling and oil-gas recovery, or can be regulated to be in an accumulated oil removing state; an accumulated oil discharging outlet is formed by drilling from outside to communicate transversely with the radially extending chamber; the regulatory controlling means has an exposed cap for force exerting for rotating and positioning, and is provided on its shank with a radially-extending hole extending through the shank and able to be optionally communicated with the axial central hole of the oil-gas connecting pipe and the through hole with a predetermined length during rotating, and is provided on the shank with a connecting hole formed by drilling in another angular direction to communicate with the radially-extending hole (but not extend through the shank) and able to optionally communicate with the accumulated oil discharging outlet during rotating.

The present invention will be apparent in its novelty and features after reading the detailed description of the preferred embodiment thereof in reference to the accompanying drawings.

DETAILED DESCRIPTION OF THE PREFERRED EMBODIMENT

Figure 1:
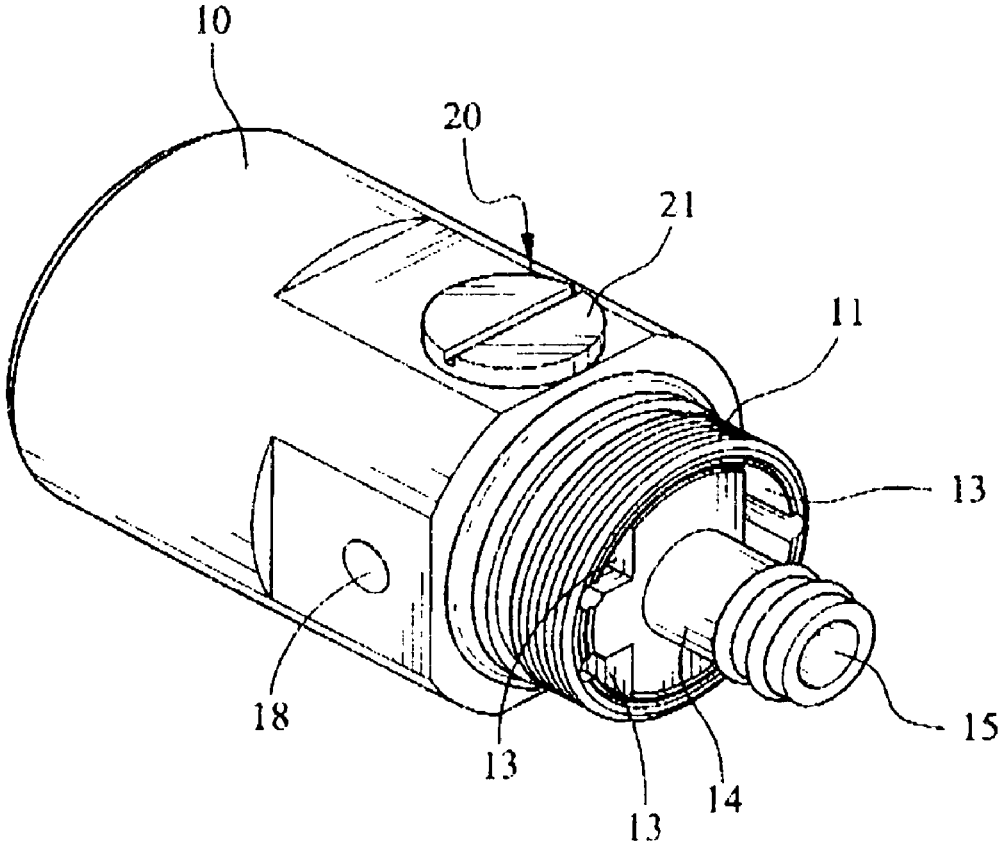
FIG. 1 is a perspective view of a preferred embodiment of the present invention.
Figure 2:
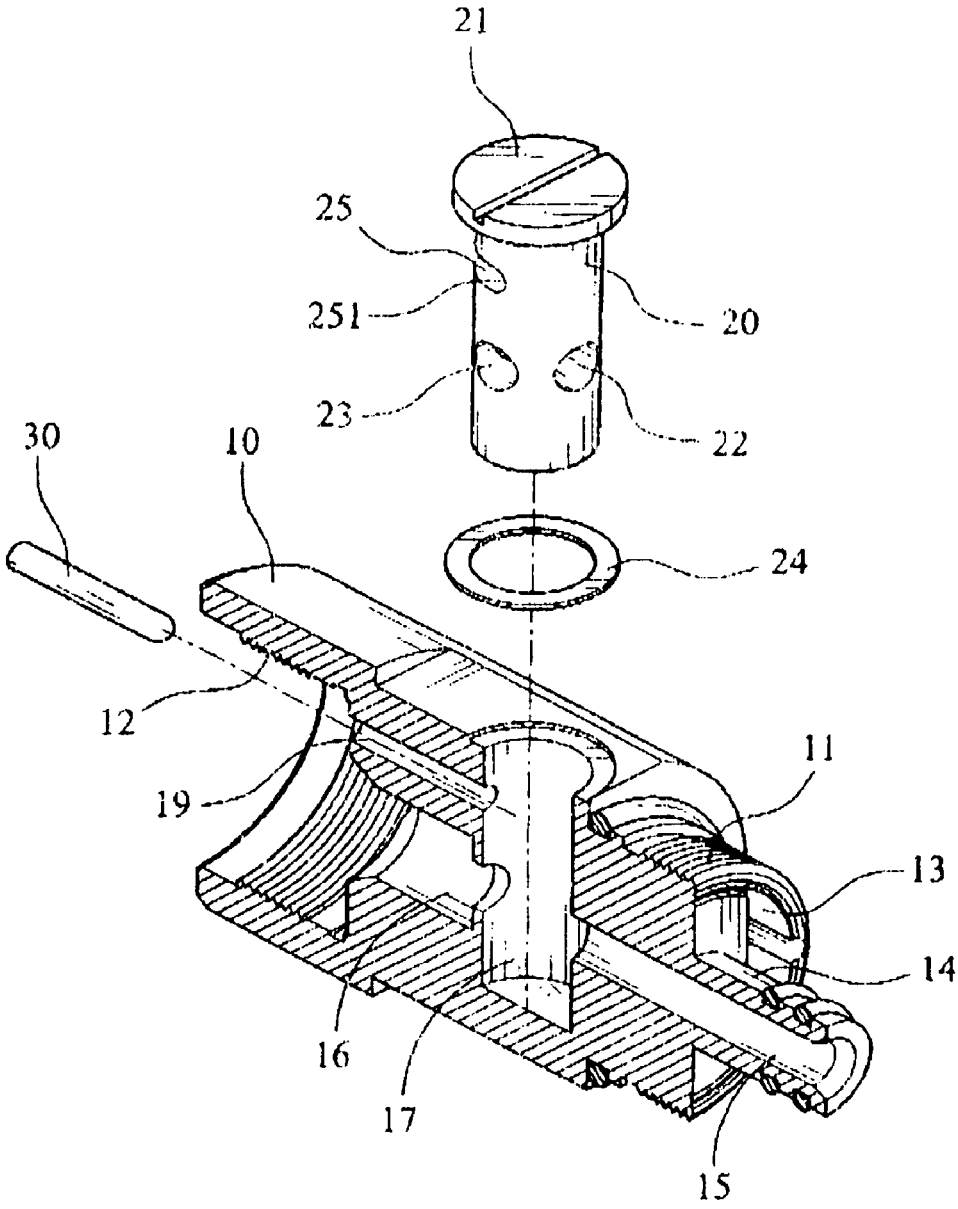
FIG. 2 is an exploded analytic perspective view showing the related elements in FIG. 1.

Referring to FIGS. 1 and 2, the present invention is provided with a main body 10 having an outer screw-connecting end 11 and a rear inner screw hole 12, so that its front end and rear end are respectively screw connected with and positioned at corresponding areas on a pipeline of an oil-gas recovery system.

The main body 10 is provided with a plurality of oil passageways 13 on the inner wall thereof, the oil passageways 13 extend from the front end to and communicating with the rear end of the main body 10; and oil-gas connecting pipe 14 spaced away from the oil passageways 13 is provided on the front end of the main body 10, and includes an axial central hole 15 with a predetermined diameter.

The rear inner screw hole 12 of the main body 10 is extended further inwardly to be provided with a through hole 16 with a predetermined length and is concentric with the axial central hole 15 of the oil-gas connecting pipe 14; a radially extending chamber 17 is extended down a predetermined depth from the top surface of the main body 10 (but not extend through the main body 10) and is communicated on its two lateral sides with the axial central hole 15 of the oil-gas connecting pipe 14 and the through hole 16; a regulatory controlling means 20 is mounted in the radially extending chamber 17 to control normal oil filling and oil-gas recovery, or can be regulated to be in an accumulated oil removing state; an accumulated oil discharging outlet 18 is formed by drilling from outside to communicate transversely with the radially extending chamber 17.

In this preferred embodiment shown, the regulatory controlling means 20 is in the shape in coincidence with that of the radially extending chamber 17, it has an exposed cap 21 for force exerting for rotating the entire regulatory controlling means 20, and is provided on its shank at least with a radially extending hole 22 extending through the shank, and is provided on the shank with a connecting hole 23 formed by drilling in another angular direction (in the drawing, it is 90 degrees away from the direction of the radially extending hole 22) to communicate with the radially extending hole 22 (but not extend through the shank). The entire regulatory controlling means 20 connecting with the radially extending chamber 27 can be provided with a sealing ring 24 near the exposed cap 21 to form a sealing function, the regulatory controlling means 20 can be rotated for adjusting.

In order to get an accurate rotating function, in the preferred embodiment shown, the regulatory controlling means 20 is provided at a predetermined position on the outer periphery of its shank with an arciform recess 25 of the predetermined length. The peripherally extending length of the arciform recess 25 is about the distance from the radially extending hole 22 to the central line of the connecting hole 23. A positioning pin 30 can be inserted in an eccentric axial hole 19, its front end is partially extended into the arciform recess 25 of the regulatory controlling means 20, in order that the two ends 251 of the arciform recess 25 (referring to FIG. 2 which only shows an end) can be limiting points in the stroke of clockwise and counter clockwise rotations. This example of the device for rotating and positioning having the positioning pin 30 and the arciform recess 25 is only for the convenience of illustrating the present invention. It will be apparent to those skilled in this art that, the area on the surface of the main body 10 near the exposed cap 21 of the regulatory controlling means 20 can be alternatively provided with a related stop pin to similarly limit the strokes of rotating of the regulatory controlling means 20.

Figure 3:
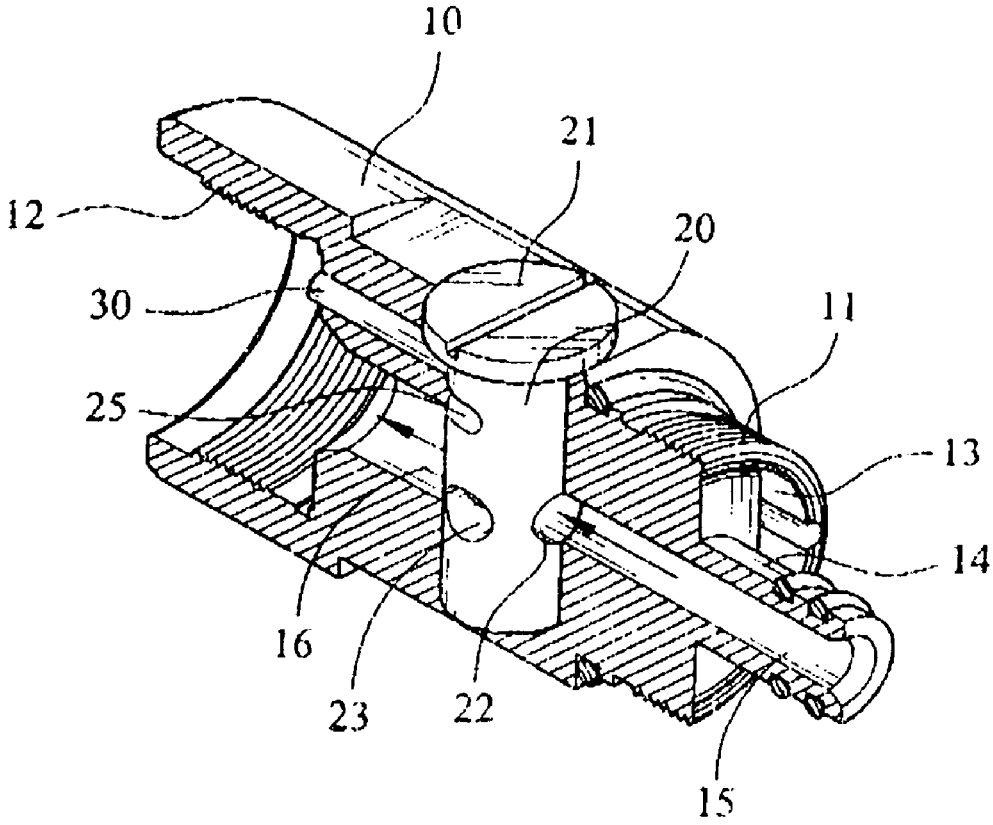
FIG. 3 is an exploded analytic perspective view showing assembling of the elements in FIG. 2.
Figure 4:
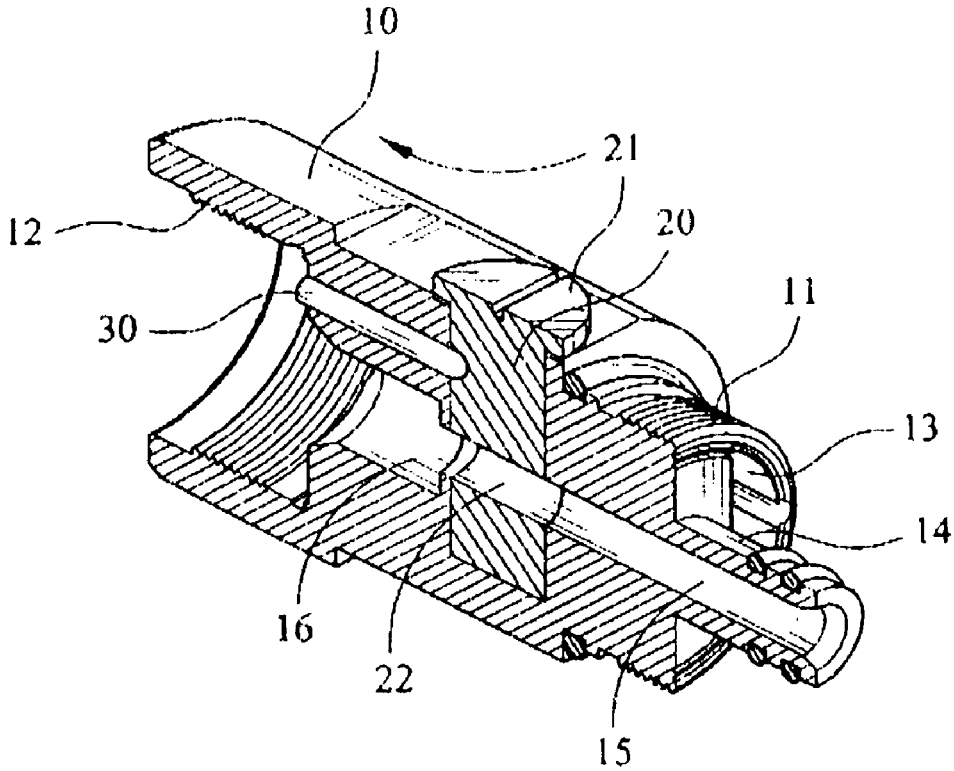
FIG. 4 is an exploded analytic perspective view showing the normal state for oil filling and oil recovery.
Figure 5:
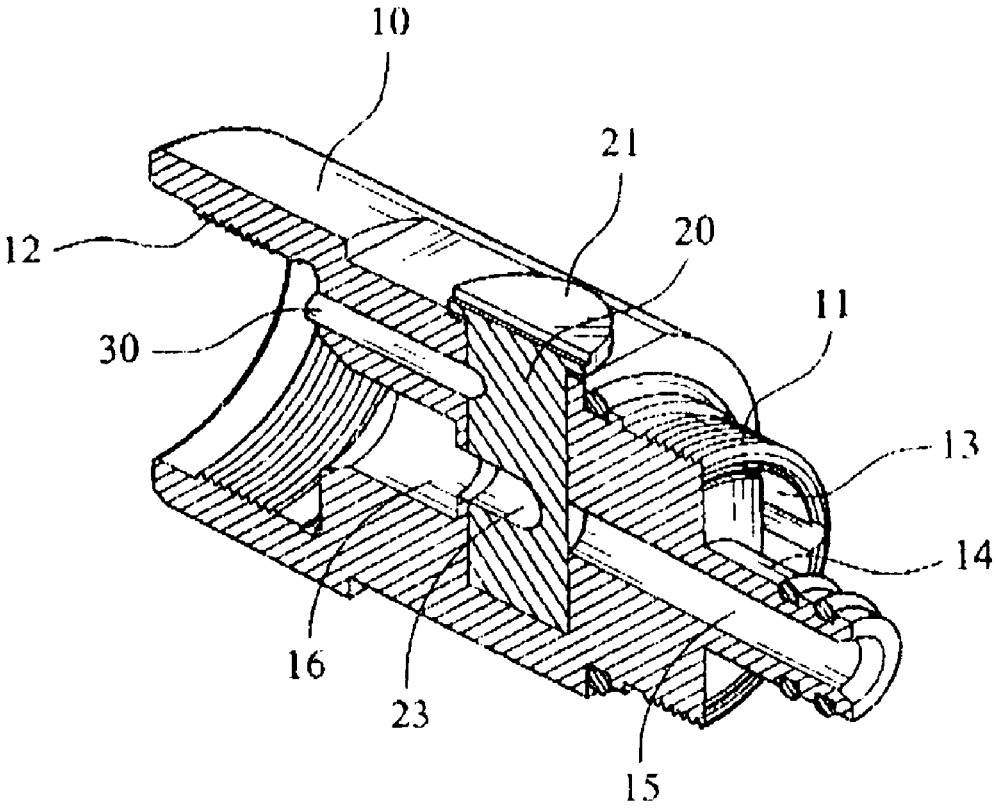
FIG. 5 is an exploded analytic perspective view showing a state for eliminating the oil accumulating situation being changed from the state of FIG. 4 by adjusting.

As shown in FIGS. 1, 3 and 4, in a normal state, the regulatory controlling means 20 of the present invention is rotated to render its shank to communicate with the radially extending hole 22, the axial central hole 15 and the through hole 16 on the opposite side and is used as an oil-gas recovery pipeline, so that the oil gas is recovered along the arrow direction depicted in FIG. 3, while the filled in oil is sent out via the oil passageways 13. When the regulatory controlling means 20 is rotated to a position as shown in FIG. 5, the radially extending hole 22 renders the axial central hole 15 of the main body 10 sealed by its angular rotating (in this embodiment shown, it rotates for 90 degrees). Under this rotating and adjusting state, the axial central hole 15 of the main body 10 rotated for 90 degrees will communicate with the accumulated oil discharging outlet 18 provide in the main body 10 (referring to FIG. 1), meantime, the connecting hole 23 is opened to the inner through hole 16 (referring to FIG. 5) at this time, the interior accumulated oil is discharged out of the recovery system through the through hole 16, the connecting hole 23, the radially extending hole 22 and the accumulated oil discharging outlet 18.

Figure 6:
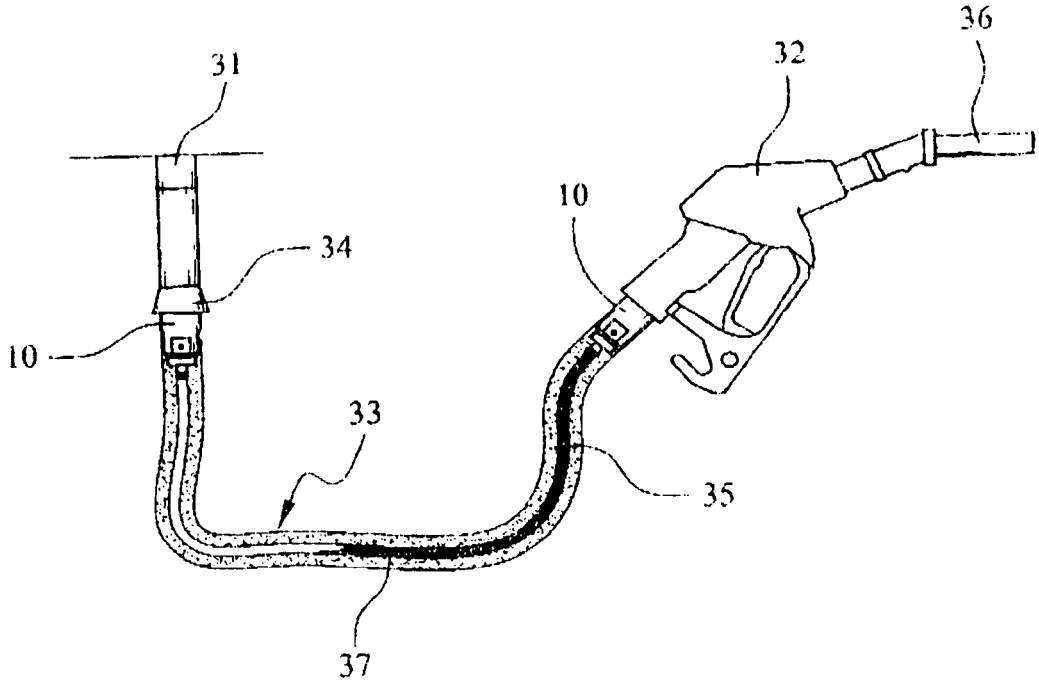
FIG. 6 is a schematic view showing the present invention is mounted on a related oil filling equipment.

As shown in FIG. 6, when the present invention is mounted on an oil filling system having an oil outlet 31 of an oil filler, an oil pipeline 33 and an oil gun 32, two accumulated oil discharging outlets 18 of the type stated above can be respectively mounted beneath an emergence relief valve 34 and on the rear of the oil gun 32, such that they can respectively connect and communicate with the oil pipeline 33 and an inner oil-gas recovery pipe 35. When in a normal state for oil filling, the accumulated oil discharging outlets 18 are both in the open state as shown in FIGS. 1, 3 and 4, oil gas can be recovered via an oil-gas recovery outlet 36 provided near the front end of the oil gun 32 along the inner oil-gas recovery pipe 35. When it is desired to discharge the interior accumulated oil 37 of the inner oil-gas recovery pipe 35, the regulatory controlling means 20 shall be rotated to a closed position as shown in FIG. 5, then the oil gun 32 can be inclined to discharge the interior accumulated oil 37 for collection.

The above structure of the present invention thus can fast and conveniently discharge oil without dismantling the oil gun and related oil pipes; this can effectively prevent various disadvantages induced by oil accumulation of the oil-gas recovery system under the condition of saving manpower and working hours.

The above stated embodiment is only for illustrating the present invention and not for giving any limitation to the scope of the present invention. It will be apparent to those skilled in this art that various equivalent modifications or charges shall fall within the scope of the appended claims and are intended to form part of this invention.

What is claimed is:

1. An accumulated oil separator for an oil-gas recovery system, said oil separator is provided with a main body having an outer screw-connecting end and a rear inner screw hole; said main body is provided with a plurality of oil passageways on an inner wall of and extending from a front end to and communicating with a rear end of said main body; an oil-gas connecting pipe spaced away from said oil passageways is provided on said front end of said main body, and has an axial central hole with a predetermined diameter; and a through hole with a predetermined length is extended inwardly from said rear inner screw hole and is concentric with said axial central hole of said oil-gas connecting pipe; a radially extending chamber is extended downwardly a predetermined depth from a top surface of said main body and is communicated on its two lateral sides with said axial central hole of said oil-gas connecting pipe and said through hole with a predetermined length; a regulatory controlling means is mounted in said radially extending chamber to control normal oil filling and oil-gas recovery, or is regulated to be in an accumulated oil removing state, an accumulated oil discharging outlet is formed by drilling from outside to communicate transversely with said radially extending chamber; said regulatory controlling means has an exposed cap for force exerting for rotating and positioning, and is provided on its shank with a radially-extending hole extending through said shank and is adapted to being optionally communicated with said axial central hole of said oil-gas connecting pipe and said through hole with a predetermined length during rotating, and is provided on said shank with a connecting hole formed by drilling in another angular direction to communicate with said radially-extending hole (but not extend through said shank) and adapted to optionally communicating with said accumulated oil discharging outlet during rotating.

2. An accumulated oil separator for an oil-gas recovery system as claimed in claim 1, wherein, said regulatory controlling means is provided with a device for rotating to make stroke deviation and for positioning.

3. An accumulated oil separator for an oil-gas recovery system as claimed in claim 2, wherein, said device for rotating to make stroke deviation and positioning includes an arciform recess of a predetermined length provided at a predetermined position on an outer periphery of said shank of said regulatory controlling means; a positioning pin is adapted to inserting in an eccentric axial hole, its front end is partially extended into said arciform recess of said regulatory controlling means, in order that two ends of said arciform recess function as limiting points to strokes of rotation of said regulatory controlling means.

* * * * *